US005390842A

United States Patent [19]

Joyce

[11] Patent Number: 5,390,842

[45] Date of Patent: Feb. 21, 1995

[54] UNDERPINNING MACHINE

[75] Inventor: Walter A. J. Joyce, Chorleywood, United Kingdom

[73] Assignees: Magnolia Group PLC; W. & M. Joyce Engineers Ltd., both of England

[21] Appl. No.: 1,465

[22] Filed: Jan. 7, 1993

[30] Foreign Application Priority Data

Jan. 8, 1992 [GB] United Kingdom ..... 9200295

[51] Int. Cl.[6] ..... B25C 5/02

[52] U.S. Cl. ..... 227/110; 227/152; 227/154

[58] Field of Search ..... 227/109, 114, 115, 116, 227/125, 126, 152, 154, 155

[56] References Cited

U.S. PATENT DOCUMENTS

| | | | |
|---|---|---|---|
| 3,016,538 | 1/1962 | Oussani | 227/110 |
| 3,889,865 | 6/1975 | Kuypers | 227/109 |
| 4,463,888 | 8/1984 | Geist et al. | 227/126 |
| 4,572,420 | 2/1986 | Pistorius | 227/152 |
| 4,694,984 | 9/1987 | Altwicker | 227/109 |
| 4,830,257 | 5/1989 | LIn | 227/152 |

*Primary Examiner*—Scott A. Smith
*Attorney, Agent, or Firm*—Basile and Hanlon

[57] ABSTRACT

An underpinning machine includes a worktable (11) having a central recess (17) housing one or a pair of underpinning heads (20,21; 120). The or each head has a magazine (18,19) of V-nails or wedges associated with it. In a single head version, the underpinning head (120) is power driven between two stop positions and is capable of operation by a drive plate (27) power operated (28,29) from spaced pneumatic rams disposed below the worktable. In another embodiment, two underpinning heads (20,21) are both selectively positionable within the area of the drive plate (27). The operation of the drive plate therefore automatically operates the underpinning heads whatever their position relative to fixed guides (31,32) of the apparatus which locate framing members (42) to be underpinned. By having the underpinning head indirectly actuated by the drive plate (27), a compact and flexible apparatus is provided and in the twin head version the underpinning heads can be placed very close together since there is no interference between respective drive mechanisms.

4 Claims, 7 Drawing Sheets

UNDERPINNING MACHINE

This invention relates to an underpinning machine for underpinning joints. It was particularly devised for underpinning mitred joints between lengths of picture framing but could be used for forming other types of underpinned joint, for example between a pair of members in furniture manufacture.

Present day underpinning machines are pneumatically operated. In one form, an underpinning head is arranged in line with a pneumatic piston and cylinder assembly beneath a work table. The framing members are clamped above the work table against a pair of abutments, the pneumatic piston cylinder assembly is operated and drives the underpinning head to insert a fixing, usually a "V-nail" or wedge of sharp edged metal, into the framing material.

If the framing material is other than a narrow and shallow moulding, it may be necessary to insert further wedges. This can be done either by stacking the wedges, in other words driving another wedge in at exactly the same position for a thick frame or by moving the underpinning head to a different position and then driving in a further wedge. Some types of framing may require both of these techniques to be used.

However, where the underpinning head is driven directly by the associated pneumatic piston and cylinder assembly, that assembly also has to be moved beneath the work table, giving rise to difficulties.

In order to carry out an underpinning operation, the framing members need firstly to be positioned and clamped in place against the abutments. This is also done pneumatically. It has been proposed to have a separate pneumatic drive to the clamping assembly or to utilise a single drive for both clamping and underpinning. Such arrangements have hitherto proved complicated. Because of the associated pneumatic equipment, current underpinning machines are lacking in versatility and do not allow for fast and accurate adjustment to tackle different framing materials or the multiple insertion of wedges.

It is an object of the present invention to provide a new or improved underpinning machine which overcomes or reduces some or all of these disadvantages.

Viewed from the first aspect, the invention provides an underpinning machine for underpinning a joint in a pair of members, the machine comprising a work table having abutment means to locate the members, top clamping means adapted to clamp the members during underpinning; and at least one underpinning head having operating means mounted below the work table which include a power operated drive plate, the underpinning head being capable of positional adjustment relative to the abutment means on the work table and being capable of being driven by said plate throughout a range of such positional adjustment to drive an underpinning wedge into said pair of members to underpin them.

The underpinning machine may have two or more underpinning heads. Preferably, each underpinning head is capable of such positional adjustment and both heads are operable by the drive plate.

One or both of the underpinning heads, where more than one is provided may be rendered inoperative by selectively actuable disabling means associated with the underpinning head.

The disabling means may comprise a power operated pusher means adapted to displace a wedge from a position in which it is capable of being driven by the underpinning head to a displaced position in which it is not capable of being driven by the underpinning head. Thus, the disabling means does not prevent the underpinning head from being operated but merely prevents a wedge from being driven by displacing the wedge from the position where the underpinning head acts.

Preferably, the abutment means comprise a pair of abutments, one of which is rigidly secured to the work table and the other of which has a slight positional adjustment relative to the work table.

The work table may be provided with alternative securement positions for the abutment means to enable the angle between them to be selected from a range of angles, for example corresponding to rectangular, hexagonal or octagonal frames.

In a first embodiment of the invention, a single underpinning head is provided and is movable between a pair of stop means. In this case, the underpinning head is preferably provided with power operated drive means to move it between said stop means.

In a second embodiment, the underpinning machine is provided with two underpinning heads, each of which is selectively secured in position relative to the work table.

The top clamping means of the underpinning machine may be a clamping head assembly as set out in our prior patent application Ser. No. 9114377.6.

The or each underpinning head may be fed by wedges supplied by the top loading means set out in our prior patent application number 9114378.4.

Apparatus embodying the invention will now be described in more detail by way of example only with reference to the accompanying drawings in which FIG. 1 is a plan view of a single head underpinning machine embodying the invention with parts removed for clarity.

Figure 1:
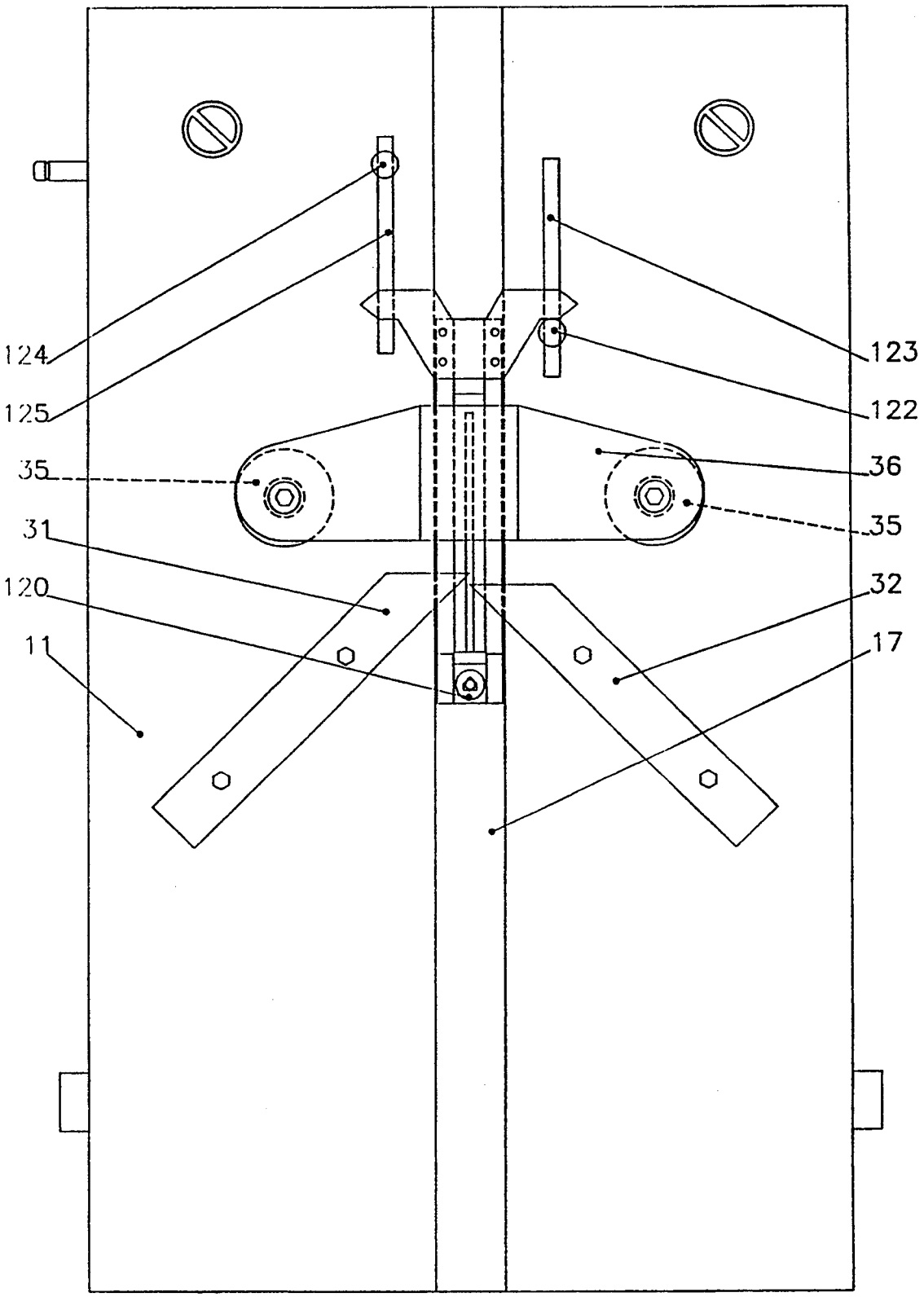

Referring to the drawings, an underpinning machine illustrated by way of example in FIGS. 1–4 of the drawings is provided with a single underpinning head. A machine having twin underpinning heads will also be described in relation to FIGS. 5–9 but since many of the features are the same as those of the single head machine, the single head machine will only be described so far as it differs from the illustrated twin head machine of FIGS. 5–9.

The underpinning machine generally indicated at 10 comprises a casing including a work table 11, a pneumatic air supply 12 and operating controls comprising a pair of switches 13, 14 and a pair of buttons 15, 16 together with a foot pedal pneumatically linked to the apparatus but not shown in the drawings.

A central recess 17 passes through the work table and receives a pair of re-usable magazines 18, 19 of underpinning V-nails or wedges. These magazines are preferably as described in our co-pending patent application Ser. No. 9114378.4 or may alternatively be single use disposable cartridges containing V-nails.

The underpinning machine 10 is provided with front and rear underpinning heads 20 and 21. These are shown in more detail in FIGS. 8 and 9; and FIGS. 6 and 7 respectively. The front underpinning head 20 uses V-nails which are fed from the magazine 19 with their point foremost. The underpinning head 21 uses wedges which are supplied by the magazine 18 and which are fed with their limbs forwards. Each magazine is fed by a respective conventional pusher system housed below the work table 11, which will not be described in detail.

Each of the underpinning heads 20, 21 is selectively positioned relative to the work table. The head 20 is linked to a clamp 22 slidably mounted on a slot 23 and provided with a graduated position scale and pointer 9. A similar clamping knob 24 in a slot 25 is used for positioning the rear underpinning head 21. In the example shown, a small gap 26 is provided between the underpinning heads since it is intended to underpin a mitred joint in relatively narrow framing material. However, the underpinning heads 20, 21 can be moved into contact with each other having an effective separation of only 12 mm or can be moved to widely separated positions, at which they can be clamped by the arrangement just described.

Figure 3:
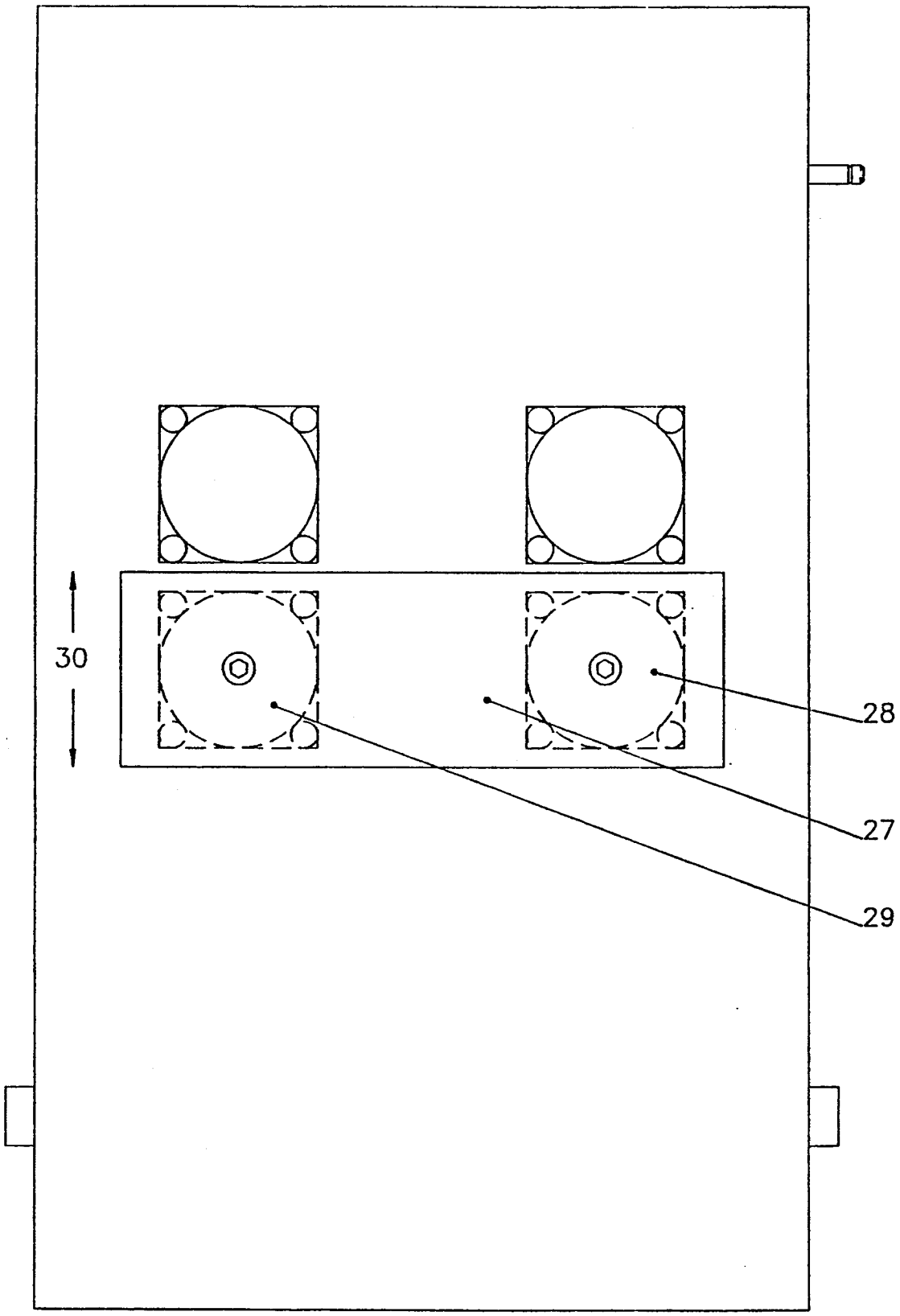
FIG. 3 is an underneath plan view of the underpinning machine of FIGS. 1 and 2 with pneumatic connections omitted for clarity.

Both of the underpinning heads are operated from beneath the work table by a power operated drive plate 27 shown in FIG. 3 which is mounted in two guides (not shown) located within the housing. The drive plate is raised and lowered by a pair of piston and cylinder assemblies 28, 29 acting in tandem. The plate 27 is raised and lowered for each underpinning operation of the machine at the maximum operating pressure of the pneumatic supply. Each time it is raised, both of the underpinning heads 20 and 21 are operated. This means that two wedges are driven into the framing material. However cycling controls, to be described later, may be used to provide a more versatile underpinning arrangement in which either one or the other head may be disabled or one head may be operated more than once, depending on the type of framing material being used.

The position of the underpinning heads 20, 21 relative to the work table can, as described, be selectively adjusted. However, provided the underpinning head lies somewhere in the area of the drive plate 27 as indicated by the arrow 30, then the underpinning head will be operated on each stroke of the piston and cylinder assemblies 28, 29.

In order to underpin a pair of frame members, they must firstly be located relative to the work table so that the miter is correctly aligned with the centre line of the work table recess 17 so that the limbs of the wedges correctly straddle the miter intersection. Abutment means are therefore provided in the form of a pair of guides 31, 32. The guide 31 is rigidly secured to the work table by a pair of fasteners. The guide 32, while being firmly secured in place, may be permitted a slight degree of adjustment due to the provision of attachment slots beneath the nuts 33. This enables accurate frames to be made even where the framing material may be slightly warped.

Alternative fixing holes for the guides 31 and 32 may be provided to enable the guides 31 and 32 to be positioned at the correct angle for a different type of joint, enabling the apparatus to be used for example for hexagonal and octagonal frames as well as rectangular frames.

Figure 2:
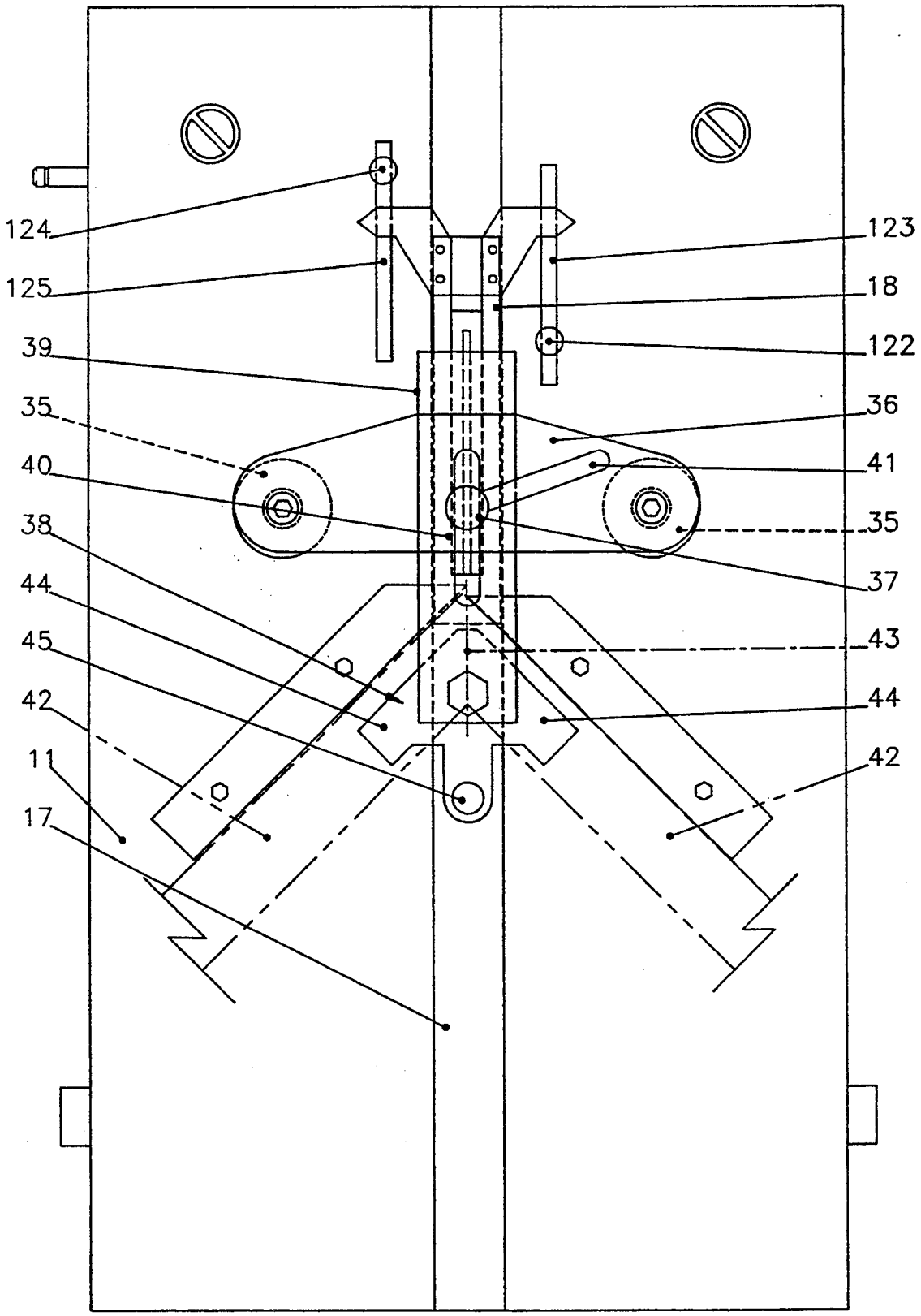
FIG. 2 is a similar plan view showing the complete underpinning machine.

When the frame members have been placed in position against the guides 31 and 32, they are clamped in position by clamping means which are shown in FIG. 2 of the drawings. The clamping means are raised and lowered by a pair of piston and cylinder assemblies 35 operating in tandem at opposite ends of a yoke 36. A clamping head is mounted by bolting at 37 to the yoke 36.

Referring to FIG. 2 of the drawings, this shows the clamping head generally indicated at 38 which may be as set out in our prior patent application Ser. No. 9114377.6. A support bar 39 has an elongate slot 40. A clamping handle 41 enables the support bar 39 to be secured to the yoke 36 at any chosen fore and aft position.

The apparatus is shown in use in FIG. 2 with a pair of framing members 42 which have been cut to form a miter 43 and presented to the guides 31 and 32 so as to locate on the centre line of the recess 17 through the work table. The yoke 36 can be lowered to bring the clamping head 38 onto the top surface of the framing members 42.

The clamping head 38 comprises a pair of main jaws 44 which act to hold down the frame members 42 and squeeze them towards the position 43 of the miter and a further spaced abutment 45 which is provided for use to steady very broad frame members and prevent them from rocking when the main clamping jaws 44 exert pressure on one edge of the member. It will be appreciated that, where narrow frame members are provided as shown at 42, the further abutment 45 may be discarded or lifted to an inoperative position. Both the clamping jaws 44 and the further abutment 45 are vertically adjustable for height by adjustment means not illustrated in detail. Reference should be made to our prior patent application Ser. No. 9114377.6 for the details.

The twin underpinning head apparatus may be arranged to cycle in four alternative modes Go be described in more detail.

| | |
|---|---|
| 1. Set Clamp | |
| Clamping head lower | pedal operation |
| Clamping head lift | pedal operation |
| 2. Manual Mode | |
| Clamping head lower | pedal operation |
| Insert rear wedge | left hand button |
| Insert front wedge | right hand button |
| Clamping head lift | pedal operation |
| 3. Auto Cycle | |
| Clamping head lower | pedal operation |
| Insert rear wedge | automatic |
| Insert front wedge | automatic |
| Clamping head lift | automatic |
| Reset cycle | pedal operation |
| 4. Auto Cycle and Manual | |
| Clamping head lower | pedal operation |
| Insert rear wedge | automatic |
| Insert front wedge | automatic |
| Insert further rear wedge | left hand button |
| Insert further front wedge | right hand button |
| Clamping head lift | pedal operation |

The modes 1 to 4 are selected by means of two two-position switches 13 and 14 previously referred to. The left hand and right hand buttons 15 and 16 are used to control the underpinning heads 20 and 21 respectively but can only be operated in modes 2 and 4. No underpinning takes place in mode 1 which is intended simply to ensure that the clamping head 38 is correctly adjusted for the type of framing to be used. The clamping pressure can be adjusted by pressure regulation means on the pneumatic supply (not illustrated).

In the automatic cycles 3 and 4, it is not necessary to use the left and right buttons since underpinning takes place by both the front and rear underpinning heads 20 and 21. However, if mode 4 is selected, additional wedges can be inserted either at the front or the rear of the frame. In this way, the wedges can be "stacked" to ensure sufficient fixing of thick framing members.

In a simplified form of twin head machine, the mode switches may be omitted and the pneumatic circuitry simplified so as to provide a single mode of operation equivalent to the manual mode referred to above. However it is possible to insert a plurality of front or rear wedges by repeated use of the left hand button or right hand button.

It will be appreciated that, as previously described, the drive plate 27, on being lifted by the piston and cylinder assemblies 28, 29, operates both underpinning heads 20 and 21. Thus, when the left hand button 15 is operated in mode 2 to drive the underpinning head 20, the plate 27 is caused to lift and would operate the underpinning head 21 under normal circumstances. However, the non-operation of the right hand button 16 causes selective disabling of the head 21 so that no wedge is driven.

This disabling takes place by means of a disabling lever means 9 mounted in each of the underpinning heads. Each disabling lever means 9 has an individual pneumatic actuator. It bears on the foremost wedge or the magazine containing the wedges to slightly displace the foremost wedge from a position in which the blade of the underpinning head can strike it as the underpinning head is operated.

Figure 5:
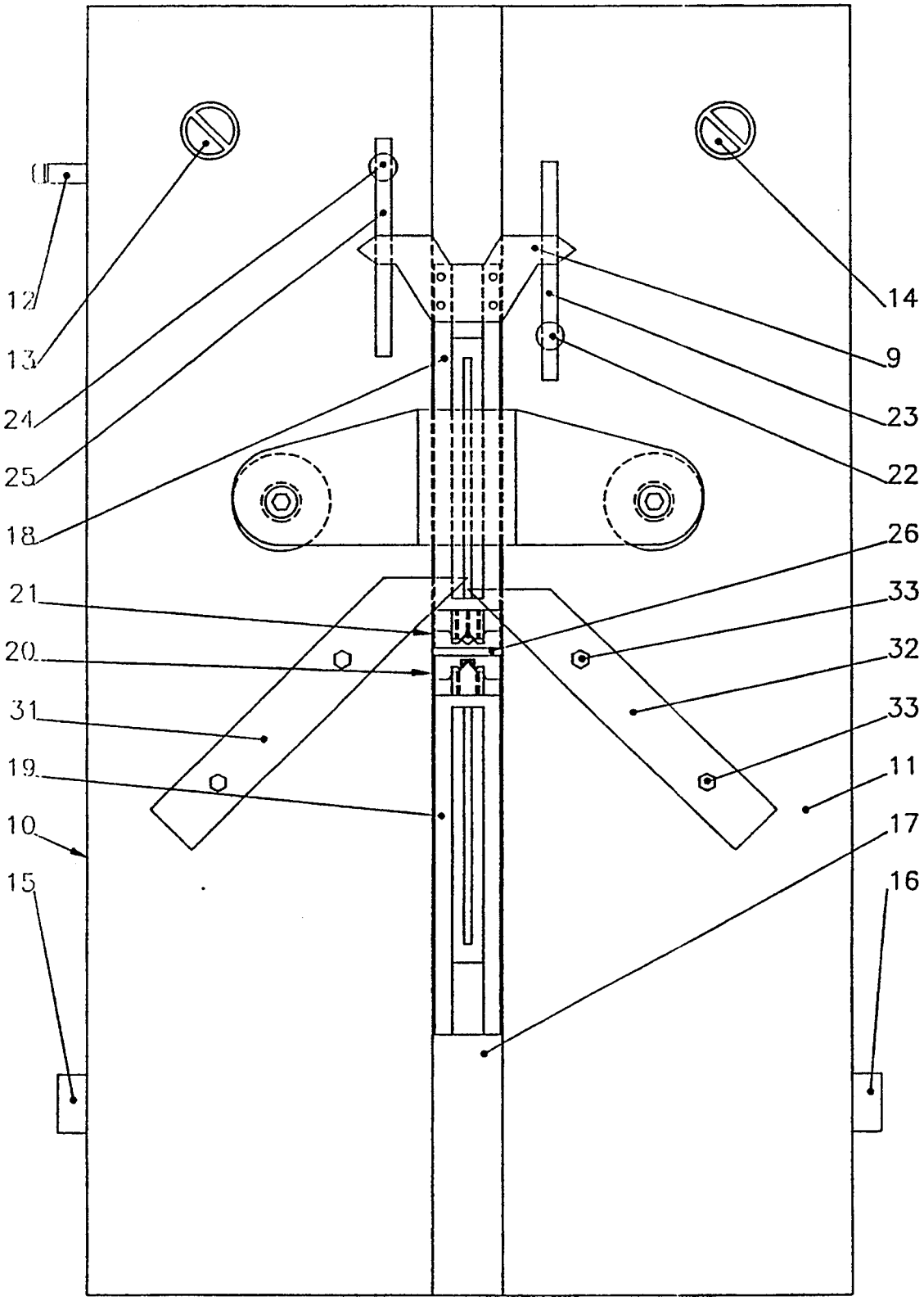
FIG. 5 is a plan view of a twin head underpinning machine embodying the invention with parts removed for clarity.

The individual underpinning heads of the twin head machine shown in FIG. 5 are illustrated in more detail in FIGS. 6–9.

Figure 6:
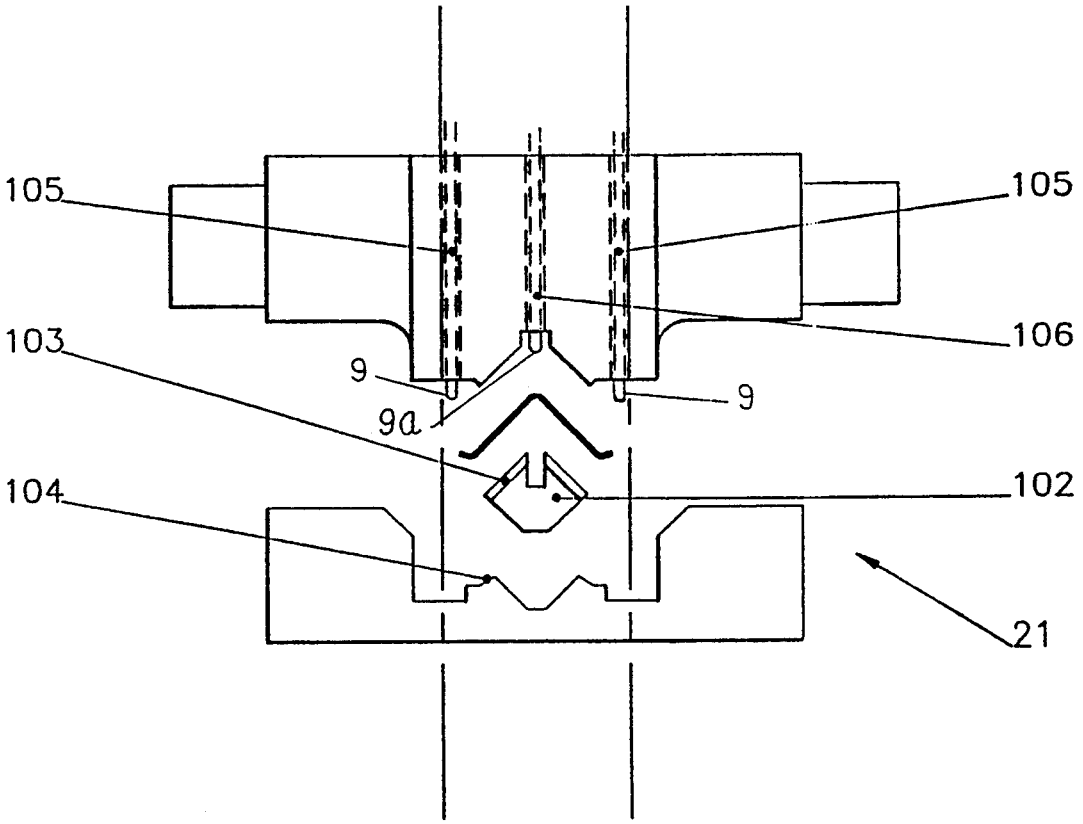
FIG. 6 is an exploded plan view of a first underpinning head of the machine of FIG. 5.
Figure 7:
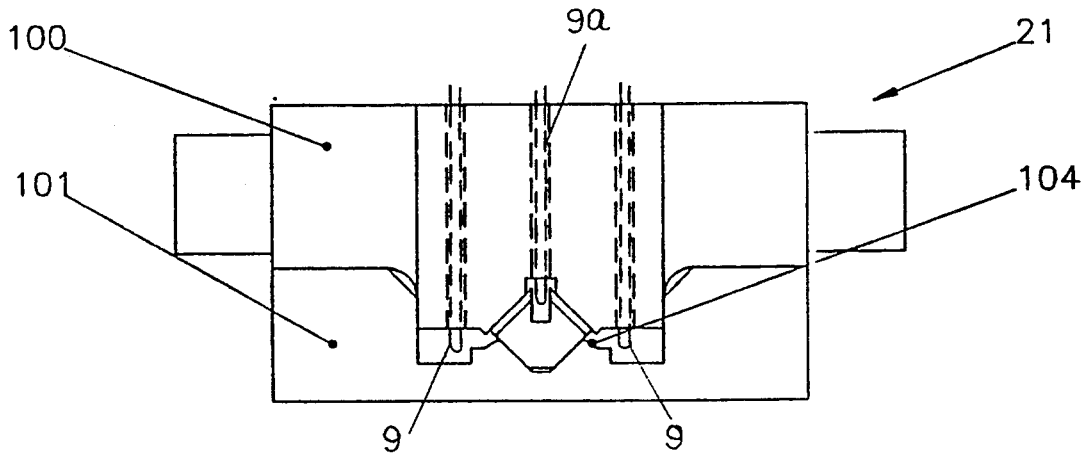
FIG. 7 is a plan view of the underpinning head of FIG. 6.

The rear underpinning head is shown in FIGS. 6 and 7 and comprises a pair of mating blocks 100, 101 having profiled surfaces illustrated in more detail in FIG. 6. A bifurcated blade 102 provided with a wedge engaging striker edge 103 is arranged to be forced upwardly by the drive plate 27 of the apparatus on each underpinning operation. It will be seen from the assembled view in FIG. 7 that a slight clearance exists between the edge 103 and the seating 104 provided for the foremost underpinning wedge. However in general, when the wedge is being pushed forward by the conventional feed means of the apparatus, the edge 103 strikes the wedge and drives it into the framing. The disabling lever means 9 operate in the slots 105 so as to push the foremost wedge against the seating 104 out of range of the edge 103 of the striker as it is raised by the drive plate. Alternatively, the lever means 9*a* can operate in the central slot 106.

Figure 8:
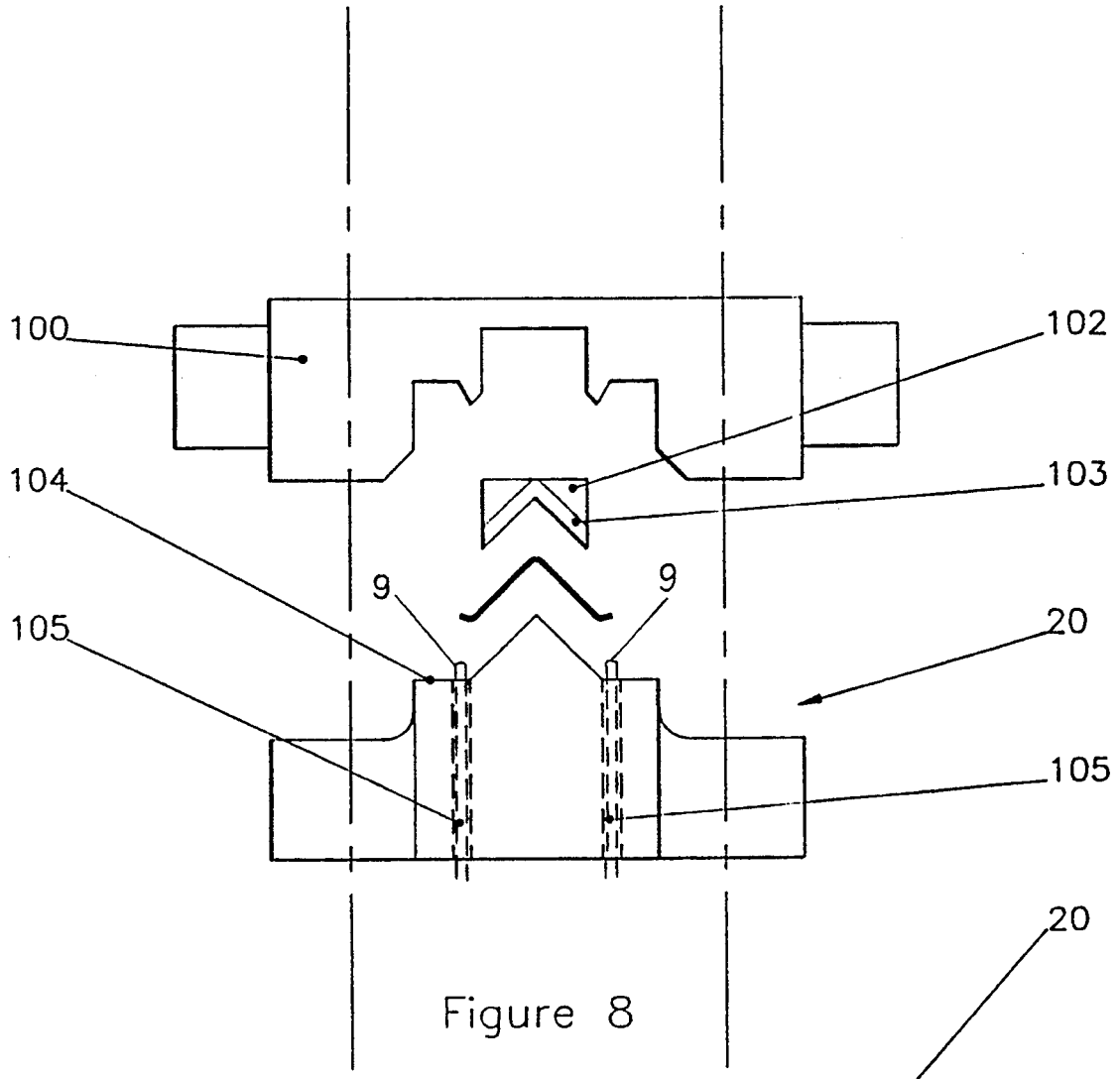
FIG. 8 is a plan view of a second underpinning head of the machine of FIG. 5.
Figure 9:
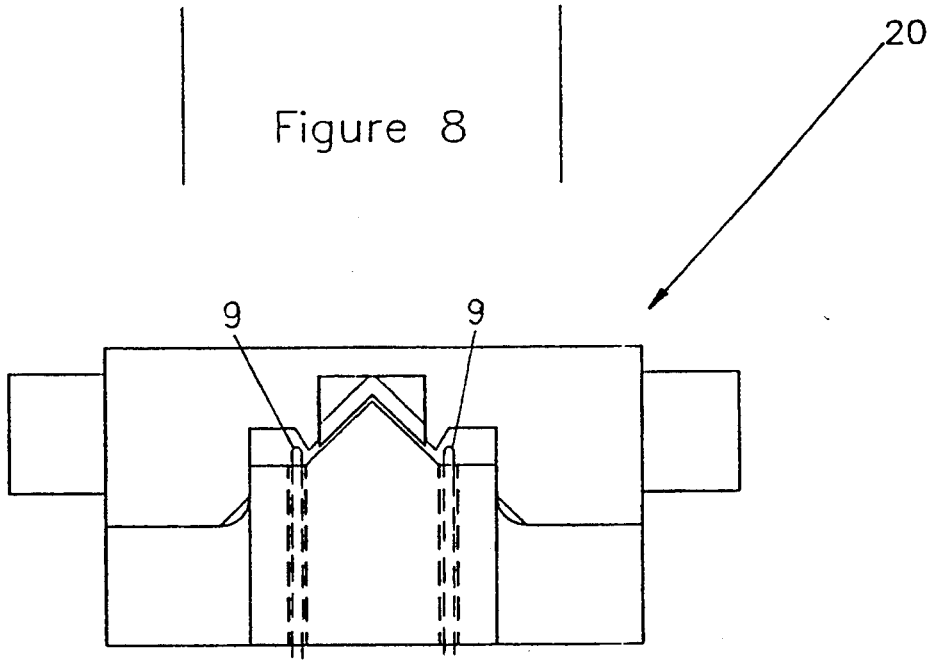
FIG. 9 is a plan view of the underpinning head of FIG. 8.

The front head shown in FIGS. 8 and 9 operates in a precisely similar way and the same reference numerals have been used. However, in this case only the outer slots 105 are provided and there is no equivalent of the alternative inner slot 106 for the disabling lever means 9*a*.

In order to operate the machine as a single head machine it is simply necessary to remove the magazine of underpinning wedges.

However a single head machine will now be described with reference to FIGS. 1 to 4, so far as it differs from the twin head machine.

Firstly, there is no equivalent of the head 21 or its associated top loader magazine 18. The underpinning head 20 is replaced by a movable head which is power driven along the central recess 17 by a head moving piston and cylinder assembly (not shown), the head moving between a pair of end stops. These are arranged to be adjusted by clamps and scales 122, 123, 124, 125.

The machine cycles in a similar way to the twin head machine previously described except that the left and right hand buttons no longer control operation of front and rear underpinning heads but now control movement of the single underpinning head to the front stop position and rear stop position. The rising drive plate arrangement 27 previously described continues to function to drive the underpinning head at whichever position it occupies.

It will be appreciated that there is no longer any need for the disabling lever means to be provided.

Figure 4:
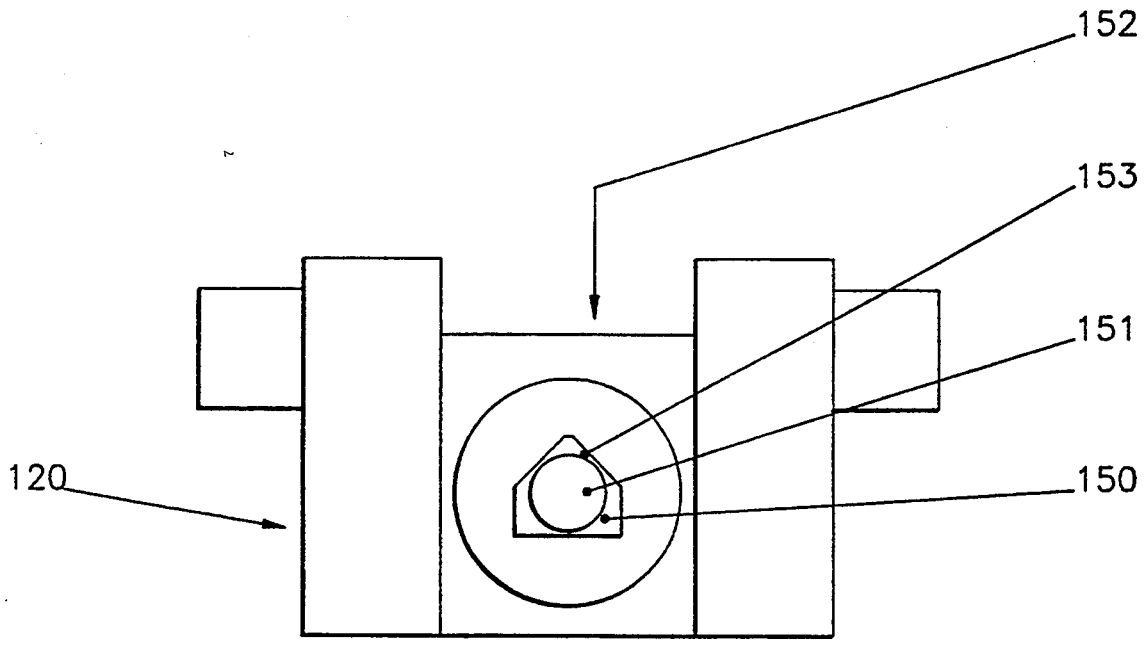
FIG. 4 is an enlarged plan view of an underpinning head of the machine of FIGS. 1–3.

A simple form of underpinning head can be used in the single head machine and this is illustrated in FIG. 4 of the drawings. The underpinning blade 150 has a generally pentagonal cross-section main body carrying a central circular cross-section pin 151 which is telescopically mounted with respect to the blade 150. The pin 151 is spring loaded into an upwardly extended position in normal operation in which it contacts the underside of the framing members to be underpinned. V-shaped wedges are fed in the direction of the arrow 152 from a magazine as previously described, the magazine being omitted for clarity. The foremost wedge is fed until it abuts the circular pin 151 and is held in that position by the pressure of the succeeding wedges in the magazine.

When the drive plate 27 is operated, the blade 150 is forced upwardly. However the pin 151 is constrained by the framing members being underpinned and does not move relative to them. It therefore telescopes inside the blade 150 as it rises, releasing the wedge which is struck by the V-shaped striker edge 153 of the blade 150 and driven into the framing member.

Thus, there is no closely fitting location for the V-nail or wedge being driven. It is merely located between the pin 150 and the remaining wedges in the magazine so that there is no danger of the wedge jamming under adverse conditions, as may occasionally occur with other forms of underpinning head.

Further, if the apparatus is actuated without framing members in position to restrain the pin 151, the rising blade 150 merely strikes the column of wedges emanating from the magazine and may break off a number of these but cannot jam them in the apparatus. A head of this type can be substituted for the rear head shown in FIGS. 6 and 7 of the twin head machine.

It will be seen that in both the previously described embodiments of the machine, considerable flexibility is allowed by the fact that the underpinning head or heads is or are driven by the rising drive plate. Thus, the drive to the underpinning head or heads remains in a stationary position and can be firmly bolted to the work table 11 whilst allowing for considerable positional adjustment of the underpinning head or heads, even bringing twin heads very close together.

In both the single and twin head machines, the different modes of operation allow the operator to provide exactly the correct underpinning for any particular type of framing member, allowing a single wedge or a plurality of wedges to be inserted at a range of separations from very close to quite widely separated, and also allowing wedges to be stacked at a single insertion position if desired.

The separation of drive to the clamping means and to the underpinning head or heads also enables the machine in one form to provide a non-operational mode, mode 1, to be used for setting the top clamp without danger of the operator inadvertently operating the underpinning head or heads. Similarly this separation of drive allows for the manual operation of the underpinning head or heads in modes 2 or 4.

In use, either version of the machine can be set up to work with a particular type of framing member very rapidly, by use of the adjustable clamps 22 and 24 and their associated scales. The operator can note the scale position for each clamp which is associated with a particular type of framing member and set up the underpinning machine appropriately.

Similarly, the positioning of the top clamping means 38 can readily be adjusted so as to hold the framing members securely at the correct position for underpinning, using the first "set clamp" mode.

I claim:

1. An underpinning machine for underpinning a joint in a pair of members using one or more underpinning wedges, said underpinning machine comprising:

a work table;

a pair of abutments on said work table to locate said members;

top clamps for clamping said members to said work table in abutment with each other and with said abutments;

a plurality of underpinning heads, each said underpinning head having an actuating mechanism;

each of said actuating mechanisms being mounted below said work table;

a power operated drive plate being provided below said work table;

at least one of said underpinning heads being capable of a range of positional adjustment relative to said abutments on said work table;

each of said actuating mechanisms drivable by said power operated drive plate throughout said range of positional adjustment, to drive one of said underpinning wedges into said pair of members to underpin said pair of members; and at least one of said actuating mechanisms including a selectively actuable disabling device for disabling said underpinning head operable by said at least one actuating mechanism.

2. An underpinning machine according to claim 1 further comprising two underpinning heads only.

3. An underpinning machine according to claim 1 wherein each of said underpinning heads is capable of positional adjustment.

4. An underpinning machine according to claim 1 wherein the disabling device comprises a power operated pusher acting at said actuating mechanism which, in a disabling operation, displaces one of said underpinning wedges from a position in which said underpinning wedge is capable of being driven by one of said underpinning heads to a displaced position in which said underpinning wedge is not capable of being driven by said underpinning head.

* * * * *